US009746210B2

(12) United States Patent
Ko et al.

(10) Patent No.: US 9,746,210 B2
(45) Date of Patent: Aug. 29, 2017

(54) AIR CONDITIONER AND METHOD OF CONTROLLING THE SAME

(71) Applicant: LG ELECTRONICS INC., Seoul (KR)

(72) Inventors: Younghwan Ko, Seoul (KR); Byeongsu Kim, Seoul (KR); Beomchan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 111 days.

(21) Appl. No.: 14/825,935

(22) Filed: Aug. 13, 2015

(65) Prior Publication Data

US 2016/0047576 A1 Feb. 18, 2016

(30) Foreign Application Priority Data

Aug. 14, 2014 (KR) ..... 10-2014-0105907

(51) Int. Cl.
*F25B 1/10* (2006.01)
*F25B 40/02* (2006.01)
(Continued)

(52) U.S. Cl.
CPC ..... *F25B 1/10* (2013.01); *F25B 40/02* (2013.01); *F25B 41/04* (2013.01); *F25B 43/00* (2013.01);
(Continued)

(58) Field of Classification Search
CPC .. F25B 41/04; F25B 43/00; F25B 1/10; F25B 40/02; F25B 2341/0662; F25B 2400/0401;
(Continued)

(56) References Cited

U.S. PATENT DOCUMENTS 4,787,211 A * 11/1988 Shaw ..... F25B 1/10 417/248
4,831,835 A * 5/1989 Beehler ..... F25B 41/04 62/196.1
(Continued)

FOREIGN PATENT DOCUMENTS

DE 10 2010 026 648 A1 1/2012
EP 2 631 563 A1 8/2013
(Continued)

*Primary Examiner* — Mohammad M Ali
(74) *Attorney, Agent, or Firm* — Dentons US LLP

(57) ABSTRACT

An air conditioner and a method of controlling the same are provided. The air conditioner includes first and second compressors capable of performing multi-stage compression, a condenser for condensing a refrigerant compressed in the first and second compressors, a refrigerant separation device for separating the refrigerant to be injected to the first or second compressor of the refrigerant condensed in the condenser, injection tubes extending from the refrigerant separation device to the first and second compressors to guide injection of the refrigerant, a main expansion device disposed at an outlet-side of the refrigerant separation device to decompress the refrigerant, an evaporator for evaporating the refrigerant decompressed in the main expansion device, a valve device disposed at an outlet-side of the first compressor to guide the refrigerant compressed in the first compressor to the condenser or the second compressor, and a bypass tube extending from the valve device to an suction-side of the second compressor.

21 Claims, 6 Drawing Sheets

(51) Int. Cl.
*F25B 43/00* (2006.01)
*F25B 41/04* (2006.01)

(52) U.S. Cl.
CPC ..... *F25B 2341/0662* (2013.01); *F25B 2400/0401* (2013.01); *F25B 2400/075* (2013.01); *F25B 2400/13* (2013.01); *F25B 2600/2501* (2013.01); *F25B 2600/2509* (2013.01); *F25B 2600/2513* (2013.01)

(58) Field of Classification Search
CPC ..... F25B 2400/075; F25B 2400/13; F25B 2600/2509; F25B 2600/2513; F25B 2600/2501
USPC ..... 62/86, 401
See application file for complete search history.

(56) References Cited

U.S. PATENT DOCUMENTS 5,109,678 A * 5/1992 Jaster ..... F25B 1/10 62/175
2010/0132399 A1* 6/2010 Mitra ..... F25B 9/008 62/498
2011/0023514 A1* 2/2011 Mitra ..... F25B 1/10 62/222
2011/0048041 A1* 3/2011 Asprovski ..... F25B 1/10 62/115
2011/0138825 A1* 6/2011 Chen ..... F25B 1/10 62/115
2011/0174014 A1* 7/2011 Scarcella ..... F25B 1/10 62/510
2013/0104582 A1* 5/2013 Sandkoetter ..... F25B 1/10 62/196.3
2013/0180276 A1* 7/2013 Choi ..... F25B 7/00 62/190
2013/0213084 A1* 8/2013 Takizawa ..... F04C 23/001 62/510
2014/0208785 A1* 7/2014 Wallace ..... F25B 9/008 62/115

FOREIGN PATENT DOCUMENTS

KR 10-2012-0049440 A 5/2012
KR 10-2012-0077106 A 7/2012
KR 10-2013-0096831 A 9/2013
WO 2007/142619 A2 12/2007

* cited by examiner

AIR CONDITIONER AND METHOD OF CONTROLLING THE SAME

CROSS-REFERENCE TO RELATED APPLICATIONS

The present application claims priority under 35 U.S.C. 119 and 35 U.S.C. 365 to Korean Patent Application No. 10-2014-0105907 (filed on Aug. 14, 2014), which is hereby incorporated by reference in its entirety.

BACKGROUND

The present disclosure relates to an air conditioner.

Air conditioners are household electronic appliances for maintaining indoor air in the most suitable state according to uses and purposes. For example, the air conditioners adjust indoor spaces in a cooling condition in summer and also in a warm heating condition in winter. Also, the air conditioners adjust humidity of the indoor space and indoor air in a pleasant clean condition. In detail, an air conditioner drives a refrigeration cycle in which compression, condensation, expansion, and evaporation processes of a refrigerant are performed to cool or heat the indoor space.

Such an air conditioner may be classified into a separated-type air conditioner in which an indoor unit is separated from an outdoor unit and an integrated-type air conditioner in which the indoor unit is integrated with the outdoor unit as one device. The outdoor unit includes an outdoor heat exchanger for heat-exchanging with outdoor air, and the indoor unit includes an indoor heat exchanger for heat-exchanging with indoor air. The air conditioner may switchably operate in a cooling or heating mode.

When the air conditioner operates in a cooling mode, the outdoor heat exchanger acts as a condenser, and the indoor heat exchanger acts as an evaporator. On the other hand, when the air conditioner operates in a heating mode, the outdoor heat exchanger acts as an evaporator, and the indoor heat exchanger acts as a condenser.

The air conditioner may further include a supercooling heat exchanger for supercooling a refrigerant condensed in the condenser. The main refrigerant that is heat-exchanged in the supercooling heat exchanger may be decompressed and evaporated in the evaporator, and a branch refrigerant that is heat-exchanged in the supercooling heat exchanger may be injected to the compressor. According to the structure of the air conditioner, multi-stage compression may be performed in the compressor.

The applicant of the present invention has filed an application in regard to the above-described idea.

Application No.: 10-2012-0018354, Filed date: Feb. 23, 2012, Title of the invention: Air conditioner However, according to the related art, since the refrigerant is compressed in only three-stages, the compressor has operation efficiency that is limited to less than a predetermined value.

SUMMARY

Embodiments provide an air conditioner in which a plurality of compressors perform a parallel operation or a series operation according to an operation mode.

In one embodiment, an air conditioner includes: first and second compressors capable of performing multi-stage compression; a condenser for condensing a refrigerant compressed in the first and second compressors; a refrigerant separation device for separating the refrigerant to be injected to the first or second compressor of the refrigerant condensed in the condenser; injection tubes extending from the refrigerant separation device to the first and second compressors to guide injection of the refrigerant; a main expansion device disposed at an outlet-side of the refrigerant separation device to decompress the refrigerant; an evaporator for evaporating the refrigerant decompressed in the main expansion device; a valve device disposed at an outlet-side of the first compressor to guide the refrigerant compressed in the first compressor to the condenser or the second compressor; and a bypass tube extending from the valve device to an suction-side of the second compressor.

Also, the valve device may include: an inlet to which the refrigerant compressed in the first compressor is introduced; a first outlet from which the refrigerant compressed in the compressor is discharged to an inlet-side of the condenser; and a second outlet from which the refrigerant compressed in the first compressor is discharged to the bypass tube.

Also, the air conditioner may further include: a compressor branch part for dividing the refrigerant evaporated in the evaporator to allow the refrigerant to flow to the first and second compressors; a first suction tube extending from the compressor branch part to the first compressor; and a second suction tube extending from the compressor branch part to the second compressor.

Also, the bypass tube may extend from second outlet of the valve device to the second suction tube.

Also, the air conditioner may further include: a valve connection tube connected to the first outlet of the valve device; a discharge tube for discharging the refrigerant compressed in the second compressor; and a combination part at which the valve connection tube is combined with the discharge tube.

Also, the injection tube may include a plurality of injection tubes through which a branch refrigerant that is heat-exchanged in the refrigerant separation device is divided to flow, and a refrigerant in one of the plurality of injection tubes may be injected to the first compressor, and a refrigerant in the other injection tube may be injected to the second compressor.

Also, the refrigerant separation device may include: a first supercooling heat exchanger in which the refrigerant condensed in the condenser is heat-exchanged with a first branch refrigerant divided from the refrigerant; and a second supercooling heat exchanger in which the refrigerant that is heat-exchanged in the first supercooling heat exchanger is heat-exchanged with a second branch refrigerant divided from the heat-exchanged refrigerant.

Also, the injection tube may include first and second injection tubes through which the first branch refrigerant that is heat-exchanged in the first supercooling heat exchanger is divided to flow, and the refrigerant in the first injection tube may be injected to the first compressor, and the refrigerant in the second injection tube may be injected to the second compressor.

Also, the injection tube may include third and fourth injection tubes through which the second branch refrigerant that is heat-exchanged in the second supercooling heat exchanger is divided to flow, and the refrigerant in the third injection tube may be injected to the first compressor, and the refrigerant in the fourth injection tube may be injected to the second compressor.

Also, the air conditioner may further include: a first injection expansion device disposed on the first injection tube to decompress the refrigerant; and a second injection expansion device disposed on the third injection tube to decompress the refrigerant.

Also, the refrigerant decompressed in the first injection expansion device may be injected to a high pressure-side of the first compressor, and the refrigerant decompressed in the second injection expansion device may be injected to a low pressure-side of the first compressor.

Also, the refrigerant in the second injection tube may be injected to a high pressure-side of the second compressor, and the refrigerant in the fourth injection tube may be injected to a low pressure-side of the second compressor.

Also, the valve device may operate in a first operation mode so that the refrigerant compressed in the first compressor is mixed with the refrigerant compressed in the second compressor, and the valve device may operate in a second operation mode so that the refrigerant compressed in the first compressor is suctioned into the second compressor via the bypass tube.

Also, the refrigerant separation device may include a phase separator.

Also, the air conditioner may include a check valve disposed at a suction-side of the second compressor to restrict the refrigerant from flowing from the bypass tube to a suction-side of the first compressor.

In another embodiment, a method of controlling an air conditioner including first and second compressors, a condenser, a main expansion device, and an evaporator includes: driving the first and second compressors; determining an action mode of a valve device disposed at an outlet-side of the first compressor according to an operation mode; dividing the refrigerant passing through the condenser by opening a first supercooling expansion device to allow the refrigerant to be heat-exchanged in a first supercooling heat exchanger and to flow through a first injection tube; and dividing the refrigerant passing through the supercooling heat exchanger by opening a second supercooling expansion device to allow the refrigerant to be heat-exchanged in a second supercooling heat exchanger and to flow through a third injection tube, wherein, when a first operation mode of the operation mode is performed, each of the first and second compressors performs a three-stage compression with respect to the refrigerant, and when a second operation mode is performed, the refrigerant successively passes through the first and second compressors and thus is compressed in five stages.

Also, the action mode of the valve device may include: a first action mode in which the refrigerant compressed in the first compressor is discharged to an inlet-side of the condenser when the first operation mode is performed; and a second action mode in which the refrigerant compressed in the first compressor is discharged to a suction-side of the second compressor when the second operation mode is performed.

Also, when the refrigerant flows through the first injection tube, the refrigerant may be decompressed in a first injection expansion device and injected to a high pressure-side of the first compressor.

Also, when the refrigerant flows through the third injection tube, the refrigerant may be decompressed in a second injection expansion device and injected to a low pressure-side of the first compressor.

Also, the first operation mode may be an operation mode in which an operation load higher than a preset load is needed, and the second operation mode may be an operation mode in which an operation load less than a preset load is needed.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
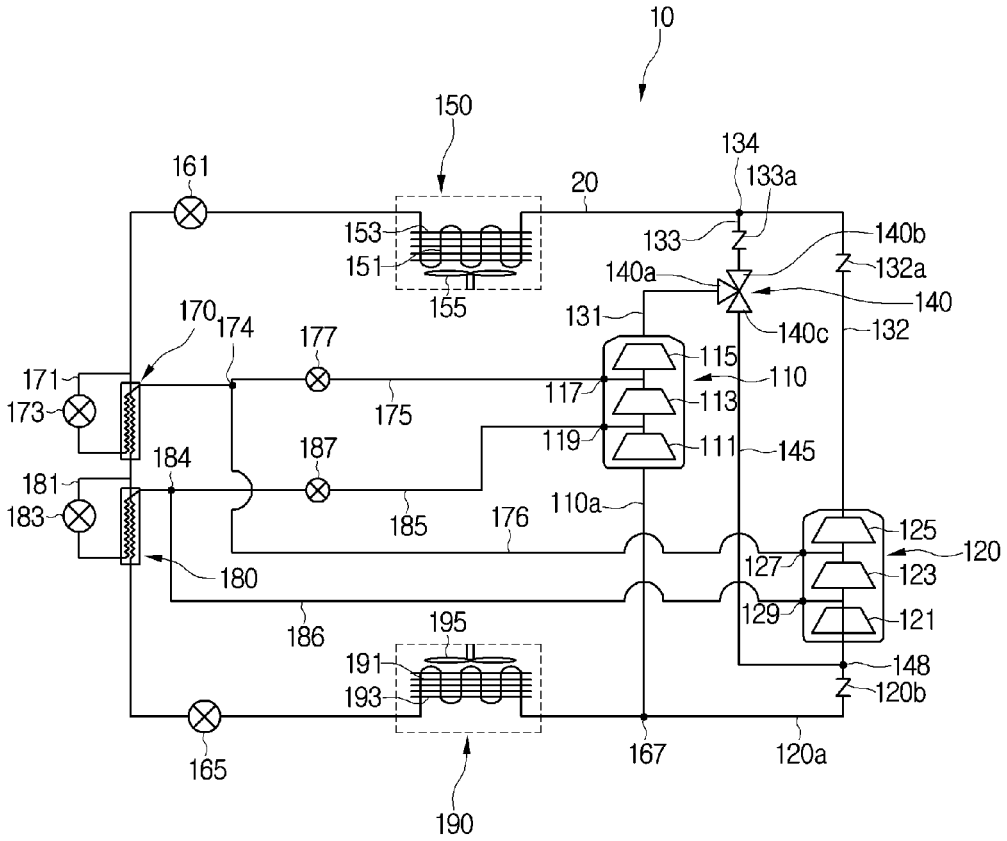
FIG. 1 is a system view of an air conditioner according to a first embodiment.

Referring to FIG. 1, in an air conditioner 10 according to the first embodiment, a refrigeration cycle in which a refrigerant circulates is driven.

The air conditioner 10 includes a plurality of compressors 110 and 120 for compressing the refrigerant, a condenser 150 in which the refrigerant compressed in the plurality of compressors 110 and 120 is condensed, main expansion devices 161 and 165 for selectively expanding the refrigerant condensed in the condenser 150, an evaporator 190 for evaporating the refrigerant expanded in the main expansion devices 161 and 165, and a refrigerant tube 20 for connecting the above-described components to each other to guide a flow of the refrigerant.

The plurality of compressors 110 and 120 has a structure in which multi-stage compression is performed. For example, the plurality of compressors 110 and 120 may include a scroll compressor in which a compression space where an operation gas is absorbed and discharged is defined between an orbiting scroll and a fixed scroll, and the refrigerant is compressed while the orbiting scroll rotates along the fixed scroll or a rotary compressor in which a compression space where an operation gas is absorbed and discharged is defined between a roller that eccentrically rotates and a cylinder, and the refrigerant is compressed while the roller eccentrically rotates along an inner wall of the cylinder.

In detail, the plurality of compressors 110 and 120 include a first compressor 110 and a second compressor 120 which operate in parallel or series.

The parallel operation represents an operation in which the refrigerant is divided into the first and second compressors 110 and 120 and compressed in each of the first and second compressors 110 and 120 and then is mixed with each other to be introduced into the condenser 150. On the other hand, the series operation represents an operation in which the refrigerant is compressed in the first compressor 110 and suctioned to be further compressed in the second compressor 120 and then is introduced into the condenser 150.

The first compressor 110 includes three compression parts 111, 113, and 115. The three compression parts 111, 113, and 115 include a first compression part 111, a second compression part 113 for additionally compressing the refrigerant compressed in the first compressor 111, and a third compression part 115 for additionally compressing the refrigerant compressed in the second compression part 113.

The second compressor 120 includes three compression parts 121, 123, and 125. The three compression parts 121, 123, and 125 include a first compression part 121, a second compression part 123 for additionally compressing the refrigerant compressed in the first compressor 121, and a third compression part 125 for additionally compressing the refrigerant compressed in the second compression part 123.

The refrigerant tube 20 includes a first suction tube 110*a* for guiding suction of the refrigerant to the first compressor 110 and a second suction tube 120*a* for guiding suction of the refrigerant to the second compressor 120. Also, the air conditioner 10 includes a compressor branch part 167 for dividing the refrigerant into the first suction tube 110*a* and the second suction tube 120*a*.

A first check valve 120*b* for allowing the refrigerant to flow in one direction from the compressor branch part 167 to the second compressor 120 may be disposed in the second suction tube 120*a*. A flow of the refrigerant from a suction-side of the second compressor 120 to the compressor branch part 167 may be limited by the first check valve 120*b*.

The refrigerant tube 20 may further include a first discharge tube 131 for guiding discharge of the refrigerant compressed in the first compressor 110 and a second discharge tube 132 for guiding discharge of the refrigerant compressed in the second compressor 120.

Also, a second check valve 132*a* for allowing the refrigerant discharge from the second compressor 120 to flow to the condenser 150 in one direction may be disposed in the second discharge tube 132. A flow of the refrigerant from a first combination part 134 to a discharge-side of the second compressor 120 may be limited by the second check valve 132*a*.

The air conditioner 10 may further include a valve device 140 for guiding the refrigerant in the discharge tube 131 toward the condenser 150 or the suction-side of the second compressor 120. For example, the valve device 140 may include a three-way valve having one inlet and two outlets. The first discharge tube 131 is connected to an inlet 140*a* of the valve device 140.

The refrigerant tube 20 may further include a valve connection tube 133 connected to a first outlet 140*b* of the two outlets 140*b* and 140*c* of the valve device 140 and a bypass tube 145 connected to a second outlet 140*c* of the two outlets 140*b* and 140*c*.

A third check valve 133*a* for allowing the refrigerant discharged from the first outlet 140*b* of the valve device 140 to flow toward the condenser 150 in one direction may be disposed in the valve connection tube 133. A flow of the refrigerant from the first combination part 134 to the first outlet 140*b* may be limited by the third check valve 133*a*.

The air conditioner 10 may further include the first combination part 134 at which the refrigerant flowing through the valve connection tube 133 is mixed with the refrigerant flowing through the second discharge tube 132.

The refrigerant flowing through the first discharge tube 131 may be introduced into the valve connection tube 133 through the valve device 140 and mixed with the refrigerant in the second discharge tube 132 and thus be introduced into the condenser 150. That is, the refrigerant introduced into the valve device 140 through the inlet 140*a* may be discharged to the valve connection tube 133 through the first outlet 140*b*. Here, an action mode of the valve device 140 may be called a "first action mode".

In the first action mode of the valve device 140, the air conditioner 10 may perform the parallel operation mode (a first operation mode) of the first and second compressors 110 and 120.

The bypass tube 145 may be understood as a tube for guiding the refrigerant discharged through the second outlet 140*c* of the valve device 140 toward the suction-side of the second compressor 120.

The bypass tube 145 may have one side portion that is connected to the second outlet 140*c* of the valve device 140 and the other side portion that is connected to a second combination part 148 of the second suction tube 120*a*. The second combination part 148 may be understood as a portion disposed on one point of the second suction tube 120*a* and to which the bypass tube 145 is connected. The refrigerant flowing through the bypass tube 145 may be mixed with the refrigerant in the second suction tube 120*a* and thus be suctioned into the second compressor 120.

The first check valve 120*b* may restrict the refrigerant from flowing from the bypass tube 145 toward the compressor branch part 167, that is, toward the first compressor 110.

That is, the refrigerant introduced into the valve device 140 through the inlet 140*a* may be discharged to the bypass tube 145 through the second outlet 140*c*. Here, an action mode of the valve device 140 may be called a "second action mode".

In the second action mode of the valve device 140, the air conditioner 10 may perform the series operation mode (a second operation mode) of the first and second compressors 110 and 120.

The condenser 150 includes a condensation tube 151 through which the refrigerant compressed in the first compressor 110 or the second compressor 120, a condensation fin 153 coupled to the condensation tube 151, and a condensation fan 155 generating a flow of air.

The main expansion devices 161 and 165 include a first main expansion device 161 disposed at an outlet-side of the condenser 150. In the first and second operation modes of the air conditioner 10, the first main expansion device 161 may be fully opened.

The air conditioner 10 includes a plurality of supercooling heat exchangers 170 and 180 allowing the refrigerant passing through the condenser 150 to be supercooled. The supercooling heat exchangers 170 and 180 include a first supercooling heat exchanger 170 and a second supercooling heat exchanger 180.

In the first supercooling heat exchanger 170, the refrigerant (hereinafter, referred to as a "first main refrigerant) passing through the condenser 150 may be heat-exchanged with the refrigerant (hereinafter, referred to as a "first branch refrigerant") divided from the first main refrigerant.

In detail, the air conditioner 10 may further include a first branch tube 171 for allowing at least one portion of the first branch refrigerant of the first main refrigerant passing through the condenser 150 to bypass and a first supercooling expansion device 173 disposed on the first branch tube 171 to decompress the first branch refrigerant.

The first branch refrigerant decompressed in the first supercooling expansion device 173 may be introduced into the supercooling heat exchanger 170 and heat-exchanged with the first main refrigerant. In this process, the first branch refrigerant may be evaporated, and the first main refrigerant may be supercooled.

The air conditioner 10 may further include a first branch part 174 for dividing the refrigerant in the first branch tube 171 to allow the refrigerant to flow into the first and second compressors 110 and 120.

The air conditioner 10 may further include a first injection tube 175 extending from the first branch part 174 to the first compressor 110 and a second injection tube 176 extending from the first branch part 174 to the second compressor 120.

The first injection tube 175 is connected to a first injection port 117 of the first compressor 110. The refrigerant in the first injection tube 175 may be injected to the first compressor 110 through the first injection port 117 and mixed with the refrigerant compressed in the second compression part 113 of the first compressor 110 and thus be introduced into the third compression part 115.

The second injection tube 176 is connected to a second injection port 127 of the second compressor 120. The refrigerant in the second injection tube 176 may be injected to the second compressor 120 through the second injection port 127 and mixed with the refrigerant compressed in the second compression part 123 of the second compressor 120 and thus be introduced into the third compression part 125.

The first injection tube 175 may further include a first injection expansion device 177 for decompressing the refrigerant when the air conditioner 10 performs the second operation mode. When the air conditioner 10 performs the first operation mode, the first injection expansion device 177 may be fully opened, and thus, the refrigerant may not be decompressed.

In the second supercooling heat exchanger 180, the refrigerant (hereinafter, referred to as a "second main refrigerant") passing through the first supercooling heat exchanger 170 may be heat-exchanged with the refrigerant (hereinafter, referred to as a "second branch refrigerant) divided from the second main refrigerant.

In detail, the air conditioner 10 may further include a second branch tube 181 for allowing at least one portion of the second branch refrigerant of the second main refrigerant passing through the first supercooling heat exchanger 170 to bypass and a second supercooling expansion device 183 disposed on the second branch tube 181 to decompress the second branch refrigerant.

The second branch refrigerant decompressed in the second supercooling expansion device 183 may be introduced into the supercooling heat exchanger 180 and heat-exchanged with the second main refrigerant. In this process, the second branch refrigerant may be evaporated, and the second main refrigerant may be supercooled.

The air conditioner 10 may further include a second branch part 184 for dividing the refrigerant of the second branch tube 181 to allow the refrigerant to flow into the first and second compressors 110 and 120.

The air conditioner 10 may further include a third injection tube 185 extending from the second branch part 184 to the first compressor 110 and a fourth injection tube 186 extending from the second branch part 184 to the second compressor 120.

The third injection tube 185 is connected to a third injection port 119 of the first compressor 110. The refrigerant in the third injection tube 185 may be injected to the first compressor 110 through the third injection port 119 and mixed with the refrigerant compressed in the first compression part 111 of the first compressor 110 and thus be introduced into the second compression part 113.

The fourth injection tube 186 is connected to a fourth injection port 129 of the second compressor 120. The refrigerant of the fourth injection tube 186 may be injected to the second compressor 120 through the fourth injection port 129 and mixed with the refrigerant compressed in the first compression part 121 of the second compressor 120 and thus be introduced into the second compression part 123.

Shortly, the refrigerant flowing through the third injection tube 185 may be injected to a low pressure-side of the first compressor 110, and the refrigerant flowing through the first injection tube 175 may be injected to a high pressure-side of the first compressor 110.

On the other hand, the refrigerant flowing through the fourth injection tube 186 may be injected to a low pressure-side of the second compressor 120, and the refrigerant flowing through the second injection tube 176 may be injected to a high pressure-side of the second compressor 120.

The third injection tube 185 may further include a second injection expansion device 187 for decompressing the refrigerant when the air conditioner 10 performs the second operation mode. When the air conditioner performs the first operation mode, the second injection expansion device 187 may be fully opened, and thus the refrigerant may not be decompressed.

The second main expansion device 165 for decompressing the refrigerant is disposed at an outlet-side of the second supercooling heat exchanger 180. The second main refrigerant passing through the second supercooling heat exchanger 180 may be decompressed in the second main expansion device 165 when the air conditioner 10 performs the first and second operation modes.

The refrigerant decompressed in the second main expansion device 165 may be introduced into the evaporator 190 and then be evaporated. The evaporator 190 includes an evaporation tube 191 through which the refrigerant flows, an evaporation fin 193 coupled to the evaporation tube 191, and an evaporation fan 195 generating a flow of the air.

The refrigerant passing through the evaporator 190 may be suctioned into the first compressor 110 or the second compressor 120 via the compressor branch part 167.

In detail, when the air conditioner 10 performs the first operation mode, the refrigerant may be divided from the compressor branch part 167 into the first and second compressors 110 and 120. On the other hand, when the air conditioner 10 performs the second operation mode, the refrigerant may be suctioned into the first compressor 110 from the compressor branch part 167 but be limited to be suctioned into the second compressor 120.

Figure 2:
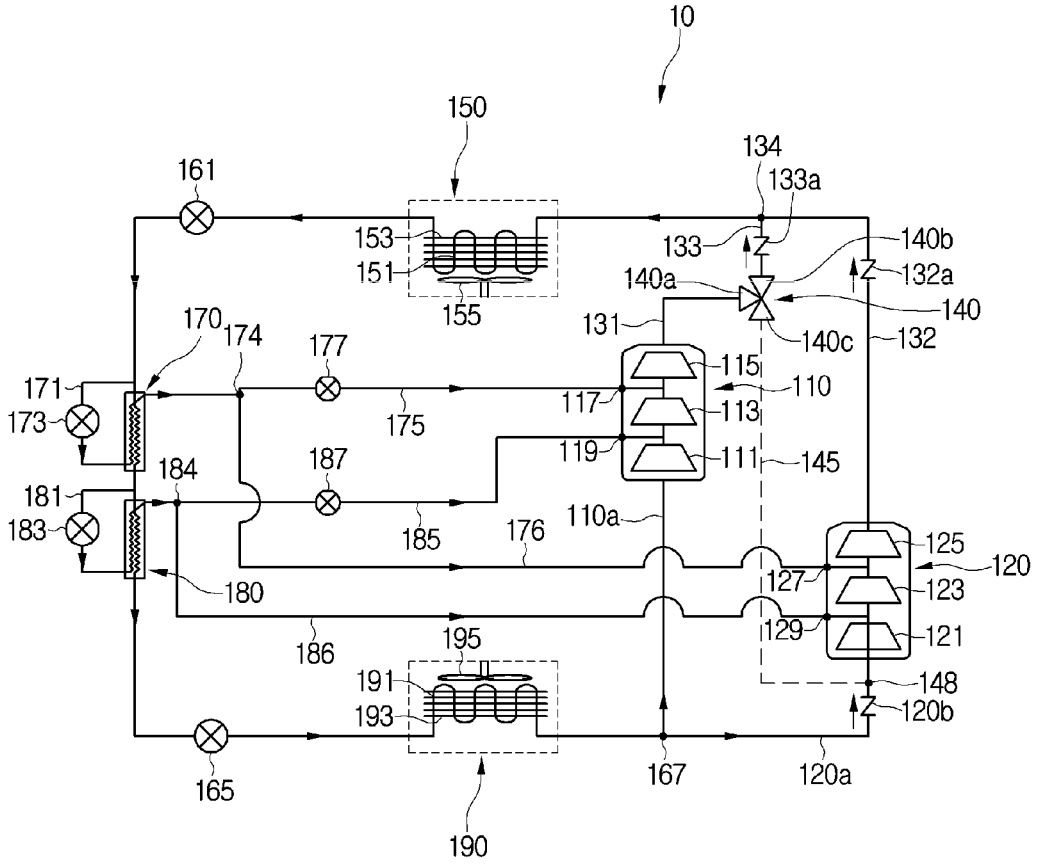
FIG. 2 is a system view illustrating a state in which a refrigerant flows when the air conditioner performs a first operation mode according to the first embodiment.
Figure 3:
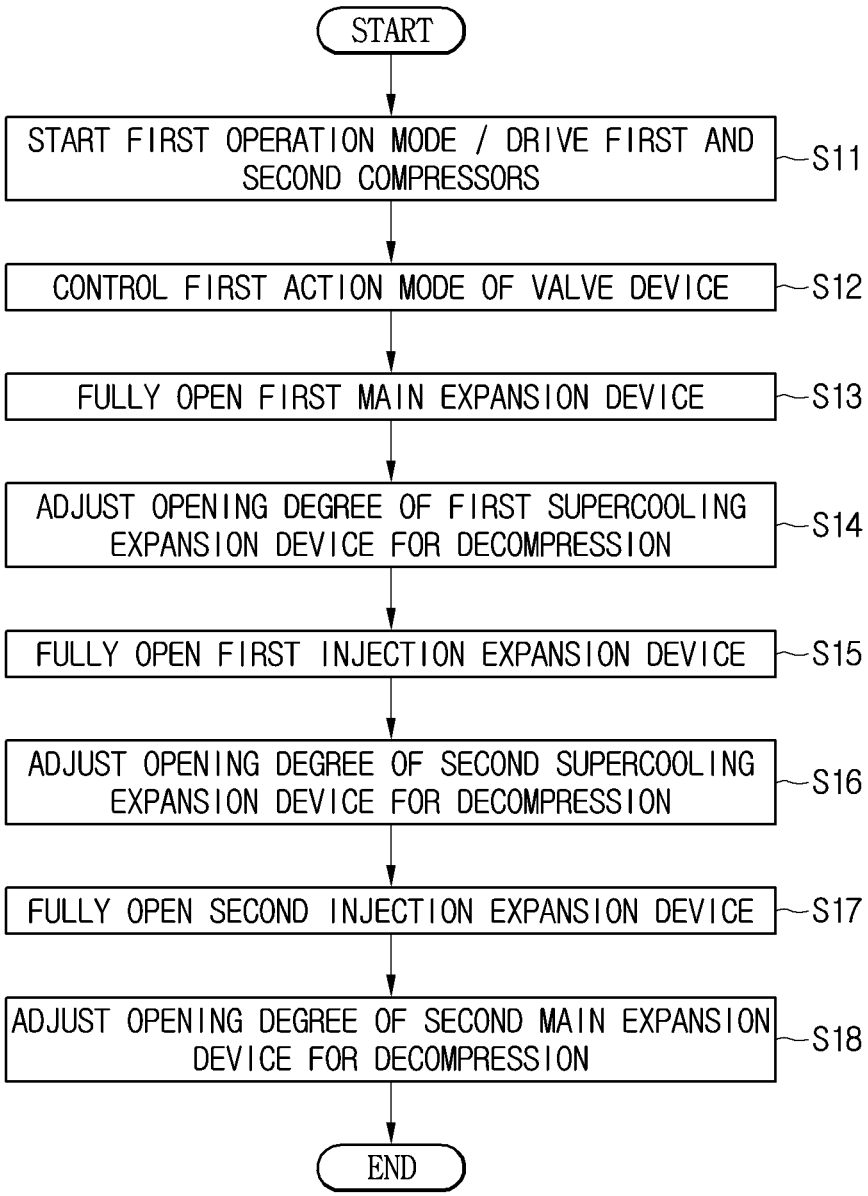
FIG. 3 is a flowchart showing a method of controlling the air conditioner when the air conditioner performs the first operation mode according to the first embodiment.

FIG. 2 is a system view illustrating a state in which a refrigerant flows when the air conditioner performs a first operation mode according to the first embodiment, and FIG. 3 is a flowchart showing a method of controlling the air conditioner when the air conditioner performs the first operation mode according to the first embodiment.

A method of controlling the air conditioner and the flow of the refrigerant when the air conditioner 10 performs the first operation mode according to the first embodiment will be described with reference to FIGS. 2 and 3.

When the first operation mode of the air conditioner 10 starts, the first and second compressors 110 and 120 are driven. Here, the "first operation mode" may be understood as a "high-load operation mode" that operates when a lot of circulation amounts of the refrigerant are required due to a high operation load of the air conditioner, that is, an operation mode in which an operation load higher than a preset load is needed.

When the first and second compressors 110 and 120 are driven, the refrigerant may be divided to flow through the first and second suction tubes 120*a* and 120*b* and then be suctioned into the first and second compressors 110 and 120. That is, in operation S11, the first and second compressors 110 and 120 may operate in parallel.

The refrigerant compressed in the first compressor 110 may be introduced into the valve device 140 to flow to the first branch part 134 through the valve connection tube 133. Here, in operation S12, the valve device 140 is controlled in the first action mode, and the refrigerant introduced into the valve device 140 may be restricted to flow into the bypass tube 145 and discharged to the valve connection tube 133 through the first outlet 140*b*.

Also, the refrigerant compressed in the second compressor 120 may flow through the second discharge tube 132 and be mixed with the refrigerant discharged from the first outlet 140 in the first combination part 134.

The refrigerant mixed in the first combination part 134 is condensed in the condenser 150 to flow through the first main expansion device. Here, in operation S13, the first main expansion device 161 may be fully opened, and thus, the refrigerant may not be decompressed while passing through the first main expansion device 161.

The refrigerant (the first main refrigerant) passing through the first main expansion device 161 may be introduced into the first supercooling heat exchanger 170. At least one portion of the first branch refrigerant of the first main refrigerant may be divided to flow into the first branch tube 171, and the first main refrigerant may be heat-exchanged with the first branch refrigerant in the first supercooling heat exchanger 170.

Here, in operation S14, the first supercooling expansion device 173 may be opened in a predetermined opening degree so that the first branch refrigerant flowing through the first branch tube 171 is decompressed.

In the process in which the decompressed first branch refrigerant is heat-exchanged with the first main refrigerant, the first branch refrigerant may be evaporated, and the first main refrigerant may be supercooled. The evaporated first branch refrigerant may be divided from the first branch part 174 to flow into the first injection tube 175 and the second injection tube 176.

The refrigerant flowing through the first injection tube 175 may be injected to the first injection port 117 of the first compressor 110 through the first injection expansion device 177. The refrigerant that is injected to the first injection port 117 may be mixed with the refrigerant compressed in the second compression part 113 of the first compressor 110. Thus, the injection of the refrigerant to the first injection port 117 may be called a "high pressure-side injection of the first compressor 110".

Here, in operation S15, the first injection expansion device 177 may be fully opened, and thus, the refrigerant flowing through the first injection tube 175 may not be decompressed while passing through the first injection expansion device 177.

The refrigerant flowing through the second injection tube 176 may be injected to the second injection port 127 of the second compressor 120. The refrigerant that is injected to the second injection port 127 may be mixed with the refrigerant compressed in the second compression part 123 of the second compressor 120. The injection of the refrigerant to the second injection port 127 may be called a "high pressure-side injection of the second compressor 120".

The refrigerant (the second main refrigerant) passing through the first supercooling heat exchanger 170 may be introduced into the second supercooling heat exchanger 180. At least one portion of the second branch refrigerant of the second main refrigerant may be divided to flow into the second branch tube 181, and the second main refrigerant may be heat-exchanged with the second branch refrigerant in the second supercooling heat exchanger 180.

Here, in operation S16, the second supercooling expansion device 183 may be opened in a predetermined opening degree so that the second branch refrigerant flowing through the second branch tube 181 is decompressed.

In the process in which the decompressed second branch refrigerant is heat-exchanged with the second main refrigerant, the second branch refrigerant may be evaporated, and the second main refrigerant may be supercooled. The evaporated second branch refrigerant may be divided from the second branch part 184 to flow into the third and fourth injection tubes 185 and 186.

The refrigerant flowing through the third injection tube 185 may be injected to the third injection port 119 of the first compressor 110 through the second injection expansion device 187. The refrigerant that is injected to the third injection port 119 may be mixed with the refrigerant compressed in the first compression part 111 of the first compressor 110. Thus, the injection of the refrigerant to the third injection port 119 may be called a "low pressure-side injection of the first compressor 110".

Here, in operation S17, the second injection expansion device 187 may be fully opened, and thus, the refrigerant flowing through the third injection tube 185 may not be decompressed while passing through the second injection expansion device 187.

The refrigerant flowing through the fourth injection tube 186 may be injected to the fourth injection port 129 of the second compressor 120. The refrigerant that is injected to the fourth injection port 129 may be mixed with the refrigerant compressed in the first compression part 121 of the second compressor 120. The injection of the refrigerant to the fourth injection port 129 may be called a "low pressure-side injection of the second compressor 120".

Like this, the refrigerant passing through the first and second supercooling heat exchangers 170 and 180 may be injected to the low pressure-side and high pressure-side of each of the first and second compressors 110 and 120, that is, injected two times, and thus, three-stage compression may be performed in each of the compressors 110 and 120.

The refrigerant passing through the second supercooling heat exchanger 180 may be introduced into the evaporator 180 through the second main expansion device 165. Here, in operation S18, the second main expansion device 165 may be opened in a predetermined opening degree so that the refrigerant is decompressed.

The refrigerant evaporated in the evaporator 190 may be divided from the compressor branch part 167, and a portion of the refrigerant of the divided refrigerant may be suctioned into the first compressor 110 through the first suction tube 110*a*, and the rest of the refrigerant may be suctioned into the second compressor 120 through the second suction tube 120*a*.

Figure 4:
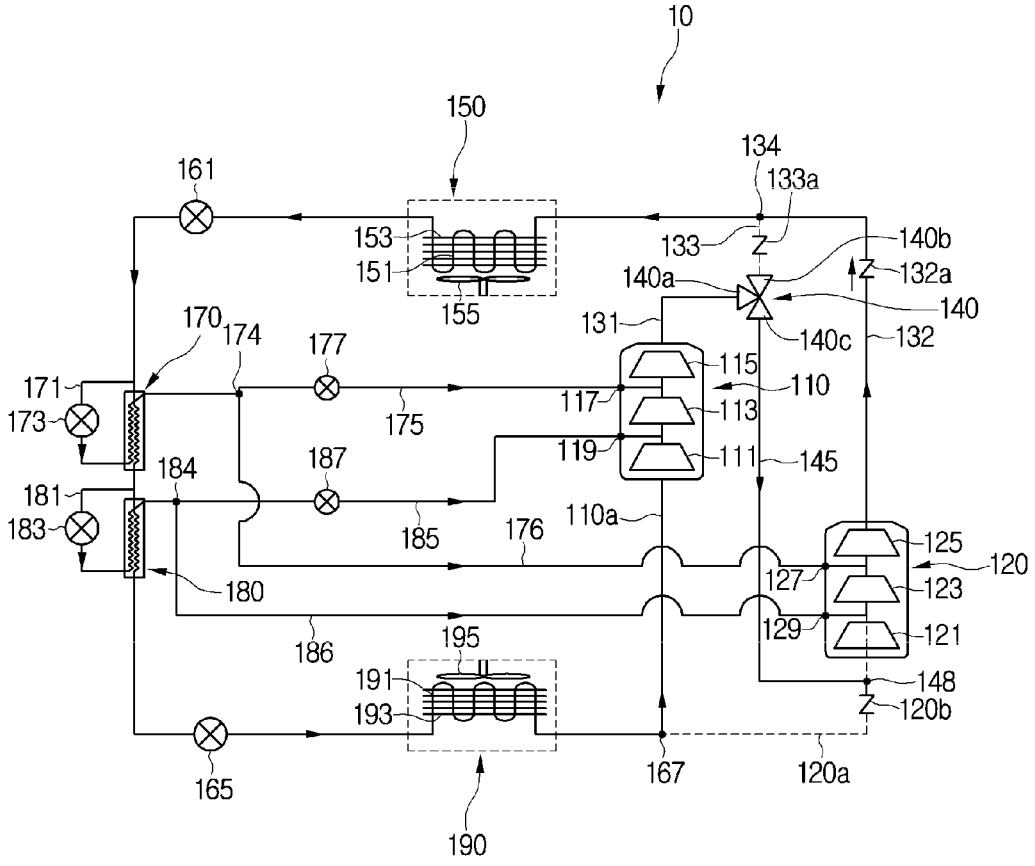
FIG. 4 is a system view illustrating a state in which the refrigerant flows when the air conditioner performs a second operation mode according to the first embodiment.
Figure 5:
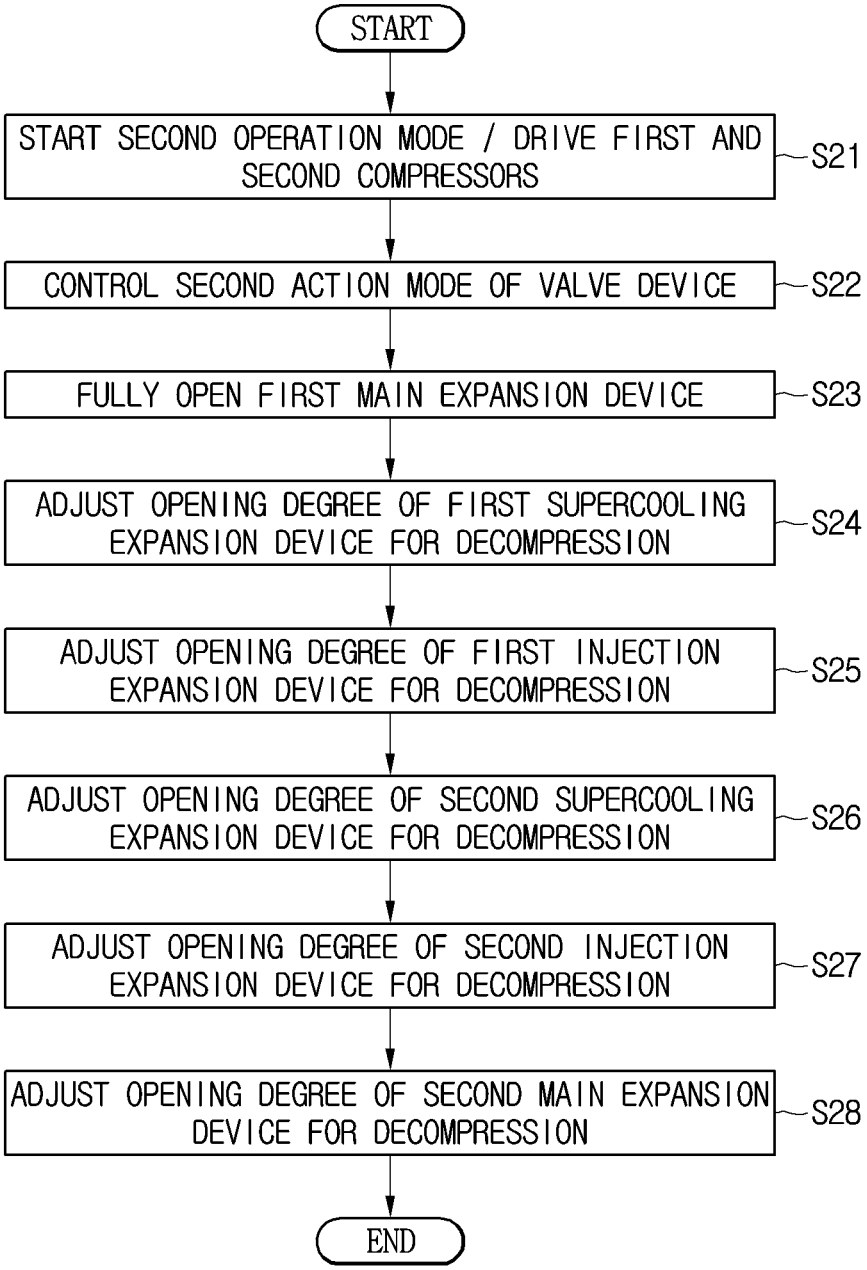
FIG. 5 is a flowchart showing a method of controlling the air conditioner when the air conditioner performs a second operation mode according to the first embodiment.

FIG. 4 is a system view illustrating a state in which the refrigerant flows when the air conditioner performs a second operation mode according to the first embodiment, and FIG. 5 is a flowchart showing a method of controlling the air conditioner when the air conditioner performs a second operation mode according to the first embodiment.

A method of controlling the air conditioner and a flow of the refrigerant when the air conditioner 10 performs the second operation mode will be described with reference to FIGS. 4 and 5.

When the second operation mode of the air conditioner 10 starts, the first and second compressors 110 and 120 are driven. Here, the "second operation mode" may be understood as a "high efficiency operation mode" or a "low load operation mode", which is capable of performing a high efficiency operation, when a lot of circulation amounts of refrigerant are required due to a low operation load of the air conditioner. Shortly, the second operation mode may be understood as an operation mode in which an operation load that is relatively less than a preset load is needed.

When the first and second compressors 110 and 120 are driven, the refrigerant may be suctioned into the first compressor 110 through the first suction tube 120*a* and suctioned in to the second compressor 120 through the bypass tube 145. That is, in operation S21, the first and second compressors 110 and 120 operate in series.

In detail, the refrigerant compressed in the first compressor 110 may be introduced into the valve device 140 to flow to the second suction tube 120*b* through the bypass tube 145. Here, in operation S22, the valve device 140 may be controlled in the second action mode, and the refrigerant introduced into the valve device 140 may be restricted from flowing to the valve connection tube 133 and discharged to the bypass tube 145 through the second outlet 140*c*.

The refrigerant in the bypass tube 145 may be introduced into the second suction tube 120*b* through the second branch part 148 and suctioned into the second compressor 120. Here, the refrigerant in the bypass tube 145 may be restricted from flowing into the compressor branch part 167 by the first check valve 120*b*.

Also, since the refrigerant in the compressor branch part 167 has a pressure that is less than that in the second branch part 148 through which the refrigerant compressed in the first compressor 110, the refrigerant may be restricted from flowing from the compressor branch part 167 to the second branch part 148. Thus, the refrigerant evaporated in the evaporator 190 may flow to the first compressor 110 via the compressor branch part 167.

The refrigerant compressed in the second compressor 120 may be introduced into the condenser 150 via the second discharge tube 132, and the refrigerant condensed in the condenser 150 passes through the first main expansion device 161. Here, in operation S23, the first main expansion device 161 may be fully opened, and thus, the refrigerant may not be decompressed while passing through the main expansion device 161.

The refrigerant (the first main refrigerant) passing through the first main expansion device 161 is introduced into the first supercooling heat exchanger 170. At least one portion of the first branch refrigerant of the first main refrigerant may be divided to flow through the first branch tube 171, and the first main refrigerant may be heat-exchanged with the first branch refrigerant in the first supercooling heat exchanger 170.

Here, in operation S24, the first supercooling expansion device 173 may be opened in a predetermined opening degree so that the first branch refrigerant flowing through the first branch tube 171 is decompressed.

While the decompressed first branch refrigerant is heat-exchanged with the first main refrigerant, the first branch refrigerant may be evaporated, and the first main refrigerant may be supercooled. The evaporated first branch refrigerant may be divided from the first branch part 174 to flow through the first and second injection tubes 175 and 176.

The refrigerant flowing through the first injection tube 175 may be injected to the first injection port 117 of the first compressor 110 through the first injection expansion device 177. The refrigerant injected to the first injection port 117 is mixed with the refrigerant compressed in the second compression part 113 of the first compressor 110. The injection of the refrigerant to the first injection port 117 may be called a "high pressure-side injection" or a "second injection" of the first compressor 110.

Herein in operation S25, the first expansion device 177 may be opened in a predetermined opening degree so that the refrigerant is decompressed.

The refrigerant flowing through the second injection tube 176 may be injected to the second injection port 127 of the second compressor 120. The refrigerant injected to the second injection port 127 may is mixed with the refrigerant compressed in the second compression part 123 of the second compressor 120. The injection of the refrigerant to the second injection port 127 may be called a "high pressure injection" or a "fourth injection" of the second compressor 123. Of course, the refrigerant to be injected to the second injection port 127 may have a pressure that is higher than that of the refrigerant injected to the first injection port 117.

The refrigerant (the second main refrigerant) passing through the first supercooling heat exchanger 170 may be introduced into the second supercooling heat exchanger 180. At least one portion of the second branch refrigerant of the second main refrigerant may be divided to flow through the second branch tube 181, and the second main refrigerant is heat-exchanged with the second branch refrigerant in the second supercooling heat exchanger 180.

Here, in operation S26, the second supercooling expansion device 183 may be opened in a predetermined opening degree so that the second branch refrigerant flowing through the second branch tube 181 is decompressed.

While the decompressed second branch refrigerant is heat-exchanged with the second main refrigerant, the second branch refrigerant may be evaporated, and the second main refrigerant may be supercooled. The evaporated second branch refrigerant may be divided from the second branch part 184 to flow through the third and fourth injection tubes 185 and 186.

The refrigerant flowing through the third injection tube 185 may be injected to the third injection port 119 of the first compressor 110 through the second injection expansion device 187. The refrigerant injected to the third injection port 119 may is mixed with the refrigerant compressed in the first compression part 111 of the first compressor 110. The injection of the refrigerant to the third injection port 119 may be called a "low pressure-side injection" or a "first injection" of the first compressor 110.

Here, the second injection expansion device 187 may be opened in a predetermined opening degree so that the refrigerant is decompressed.

That is, in operation S27, the refrigerant in the second branch tube 181 is decompressed in the second supercooling expansion device 183 and additionally decompressed in the second injection expansion device 187, and the refrigerant injected to the third injection port 117 may have a pressure that is less than that of the refrigerant injected to the first injection port 117.

The refrigerant flowing through the fourth injection tube 186 may be injected to the fourth injection port 129 of the second compressor 120. The refrigerant injected to the fourth injection port 129 is mixed with the refrigerant compressed in the first compression part 121 of the second compressor 120. The injection of the refrigerant to the fourth injection port 129 may be called a "low pressure-side injection" or a "third injection" of the second compressor 120. Of course, the refrigerant injected to the fourth injection port 129 may have a pressure that is higher than that of the refrigerant injected to the third injection port 119.

Like this, the refrigerant passing through the first supercooling heat exchanger 170 may be secondly injected to the high pressure-side and the low pressure-side of the first compressor 110 through the injection tube, and the refrigerant passing through the second supercooling heat exchanger 170 may be secondly injected to the high pressure-side and the low pressure-side of the second compressor 120 through the injection tube.

That is, since the refrigerant is fourthly injected while the refrigerant compressed in the first compressor 110 is suctioned into the second compressor 120 through the bypass tube 145 and then compressed, when a pressure stage is defined with respect to the injection of the refrigerant, it may be understood that five-stage compression is performed in total.

The refrigerant passing through the second supercooling heat exchanger 180 may be introduced into the evaporator 190 through the second main expansion device 165. Here, in operation S28, the second main expansion device 165 may be opened in a predetermined opening degree so that the refrigerant is decompressed.

The refrigerant evaporated in the evaporator 190 may be suctioned from the compressor branch part 167 to the first compressor 110 through the first suction tube 110*a*. As described above, the refrigerant in the compressor branch part 167 may be restricted from flowing to the second combination part 148 by a pressure difference.

The pressure of the refrigerant in the flow of the refrigerant of the air conditioner of FIG. 4 will be simply described.

A refrigerant pressure in the compressor branch part 167 and the first suction tube 110*a* is referred to as P1, a refrigerant pressure in the first discharge tube 131 and the second suction tube 120*a* is referred to as P2, and a refrigerant pressure in the second discharge tube 132 is referred to as P3.

Also, a refrigerant pressure in the first branch part 174 and the second injection tube 176 is referred to as P4, and a pressure of the refrigerant introduced into the first injection port 117 after passing through the first injection expansion device 177 is referred to as P5.

A refrigerant pressure in the second branch part 184 and the fourth injection tube 186 is referred to as P6, and a pressure of the refrigerant introduced into the third injection port 127 after passing through the second injection expansion device 187 is referred to P7.

The following relation formula represents the size of the refrigerant pressure.

$$P1<P7<P5<P2<P6<P4<P3$$

Hereinafter, a second embodiment will be described. Since a portion of components in the current embodiment is different from that in the first embodiment, the differences will be mainly described, and the components in the current embodiment the same as those in the first embodiment quote the descriptions of the first embodiment.

Figure 6:
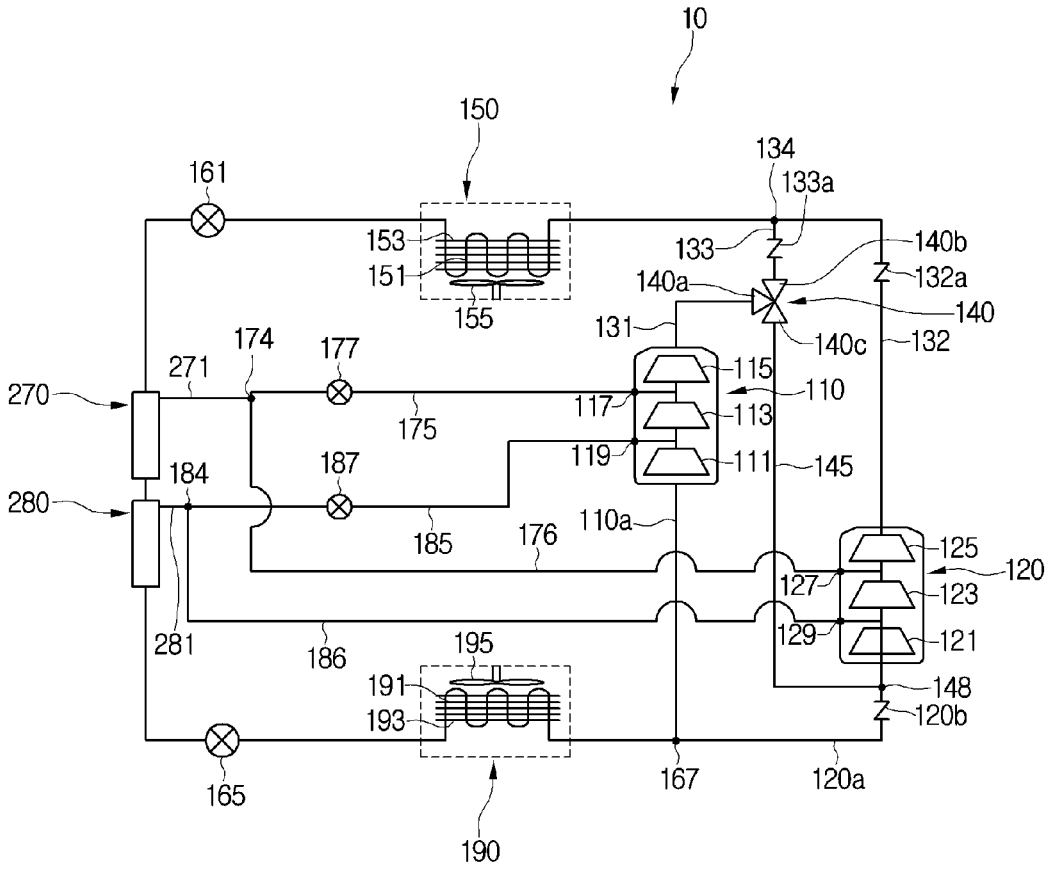
FIG. 6 is a system view of an air conditioner according to a second embodiment.

Referring to FIG. 6, an air conditioner 10' according to the second embodiment includes a plurality of phase separators 270 and 280 at an outlet-side of the condenser 150.

The plurality of phase separators 270 and 280 includes a first phase separator 270 to which a refrigerant condensed in the condenser 150 is introduced and separating a gaseous refrigerant from the introduced refrigerant and a second phase separator 280 connected in series to an outlet-side of the first phase separator 270.

The gaseous refrigerant separated from the refrigerant introduced into the first phase separator 270 may be introduced into a first branch part 174 through a first discharge tube 271. The first discharge tube 271 extends from the first phase separator 270 to the first branch part 174. Also, the rest of the refrigerant except for the separated gaseous refrigerant may be introduced into the second phase separator 280.

The refrigerant may be divided from the first branch part 174 and then be injected to the first compressor 110 through the first injection tube 175 and injected to the second compressor 120 through the injection tube 176.

The second phase separator 280 separates the gaseous refrigerant from the refrigerant. The separated gaseous refrigerant may be introduced into a second branch part 184 through a second discharge tube 281. The second discharge tube 281 extends from the second phase separator 280 to the second branch part 184. Also, the rest of the refrigerant except for the separated gaseous refrigerant may be decompressed in the second main expansion device 165 and then be introduced into the evaporator 190.

The refrigerant may be divided from the second branch part 184 and then be injected to the first compressor 110 through the third injection tube 185 and injected to the second compressor 120 through the fourth injection tube 186.

Like this, since the gaseous refrigerant is separated by the phase separator, and the separated gaseous refrigerant is injected to the compressor, power for compressing the refrigerant in the compressor may be reduced to improve cooling and heating efficiency.

Each of the supercooling heat exchanger in the first embodiment and the phase separator in the current embodiment may separate the refrigerant to be injected to the compressor and thus be called a "refrigerant separation device"

Another embodiment is suggested.

As described above, in the first embodiment, two supercooling heat exchangers are disposed in series at an outlet-side of the condenser to perform the injection of the refrigerant, and in the second embodiment, two phase separators are disposed in series at the outlet-side of the condenser to perform the injection of the refrigerant.

Alternatively, one supercooling heat exchanger and one phase separator may be disposed in series at the outlet-side of the condenser to allow the injection of the refrigerant to be performed in the first and second compressors.

According to the present disclosure, the plurality of compressors operate in parallel or series according to the operation mode of the air conditioner.

In detail, when the air conditioner has a relatively high operation load, the first operation mode is performed, and thus, the refrigerant may be divided and suctioned into the plurality of compressors to perform the parallel operation. On the other hand, when the air conditioner has a relatively low operation load, the second operation mode is performed, and thus, the refrigerant may successively pass through the plurality of compressors to perform the series operation.

According to the operation of the air conditioner, when the first operation mode is performed, the refrigerant may be compressed in three-stages in the plurality of compressors, and thus, the amount of refrigerant circulating the air conditioner may be increased to increase refrigeration ability. Also, when the second operation mode is performed, the refrigerant may be compressed in five stages to allow the air conditioner to operation in high efficiency, and thus, the optimal operation may be controlled according to the operation mode.

Also, since the air conditioner includes the supercooling heat exchanger or the phase separator, the injection of the refrigerant of the compressor may be possible, and thus, the multi-stage compression in the compressor may be efficiently performed.

In particular, when the air conditioner includes the supercooling heat exchanger, the refrigerant may be supercooled, and thus the air conditioner may be improved in operation efficiency.

Also, since the refrigerant forming the intermediate pressure is injected to the compressor, the power for compressing the refrigerant in the compressor may be reduced to increase cooling and heating efficiency.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

first and second compressors for compressing a refrigerant that is injected into the first and second compressors, wherein the compressing comprises multi-stage compression;

a condenser for condensing the refrigerant compressed in the first and second compressors;

a refrigerant separation device for separating the refrigerant before the refrigerant is injected into the first and second compressors;

injection tubes extending from the refrigerant separation device to the first and second compressors to guide the injection of the refrigerant;

a main expansion device disposed at an outlet-side of the refrigerant separation device for decompressing the refrigerant condensed in the condenser;

an evaporator for evaporating the refrigerant decompressed in the main expansion device;

a valve device disposed at an outlet-side of the first compressor for guiding the refrigerant compressed in the first compressor to the condenser or to the second compressor; and a bypass tube extending from the valve device to a suction-side of the second compressor, wherein the valve device comprises:

an inlet into which the refrigerant compressed in the first compressor is introduced;

a first outlet from which the refrigerant compressed in the first compressor and introduced into the inlet is discharged to a valve connection tube that is connected to an inlet-side of the condenser; and a second outlet from which the refrigerant compressed in the first compressor is discharged to the bypass tube.

2. The air conditioner according to claim 1, further comprising:

a compressor branch part for dividing the refrigerant evaporated in the evaporator and allowing the divided refrigerants to flow to the first and second compressors;

a first suction tube extending from the compressor branch part to the first compressor; and a second suction tube extending from the compressor branch part to the second compressor.

3. The air conditioner according to claim 2, wherein the bypass tube extends from the second outlet of the valve device to the second suction tube.

4. The air conditioner according to claim 2, wherein the valve connection tube is connected to the first outlet of the valve device, and further comprising:

a discharge tube for discharging the refrigerant compressed in the second compressor; and a combination part at which the valve connection tube is combined with the discharge tube.

5. The air conditioner according to claim 1, wherein a branch refrigerant that is heat-exchanged in the refrigerant separation device is divided to flow in the injection tubes, and a refrigerant in one of the injection tubes is injected into the first compressor, and a refrigerant in the another one of the injection tubes is injected into the second compressor.

6. The air conditioner according to claim 5, wherein the refrigerant separation device comprises:

a first supercooling heat exchanger in which the refrigerant condensed in the condenser is heat-exchanged with a first branch refrigerant divided from the refrigerant condensed in the condenser; and a second supercooling heat exchanger in which the refrigerant that is heat-exchanged in the first supercooling heat exchanger is heat-exchanged with a second branch refrigerant divided from the refrigerant that is heat-exchanged in the first supercooling heat exchanger.

7. The air conditioner according to claim 6, wherein the injection tubes comprise a first injection tube and a second injection tube through which the first branch refrigerant that is heat-exchanged in the first supercooling heat exchanger is divided to flow into, wherein the refrigerant in the first injection tube is injected into the first compressor, and wherein the refrigerant in the second injection tube is injected into the second compressor.

8. The air conditioner according to claim 7, wherein the injection tubes further comprise a third injection tube and a fourth injection tube through which the second branch refrigerant that is heat-exchanged in the second supercooling heat exchanger is divided to flow into, wherein the refrigerant in the third injection tube is injected into the first compressor, and wherein the refrigerant in the fourth injection tube is injected into the second compressor.

9. The air conditioner according to claim 8, further comprising:

a first injection expansion device disposed on the first injection tube to decompress the refrigerant in the first injection tube; and a second injection expansion device disposed on the third injection tube to decompress the refrigerant in the third injection tube.

10. The air conditioner according to claim 9, wherein the refrigerant decompressed in the first injection expansion device is injected into a high pressure-side of the first compressor, and the refrigerant decompressed in the second injection expansion device is injected into a low pressure-side of the first compressor.

11. The air conditioner according to claim 8, wherein the refrigerant in the second injection tube is injected into a high pressure-side of the second compressor, and the refrigerant in the fourth injection tube is injected into a low pressure-side of the second compressor.

12. The air conditioner according to claim 1, wherein the valve device operates in a first operation mode such that the refrigerant compressed in the first compressor is mixed with the refrigerant compressed in the second compressor, and wherein the valve device operates in a second operation mode such that the refrigerant compressed in the first compressor is suctioned into the second compressor via the bypass tube.

13. The air conditioner according to claim 1, wherein the refrigerant separation device comprises a phase separator.

14. The air conditioner according to claim 1, further comprising a check valve disposed at a suction-side of the second compressor to restrict the refrigerant from the suction-side of the second compressor from flowing to a compressor branch part.

15. A method of controlling an air conditioner comprising a first compressor, a second compressor, a condenser, a main expansion device, and an evaporator, the method comprising:

driving the first and second compressors;

determining an action mode of a valve device disposed at an outlet-side of the first compressor according to an operation mode;

dividing the refrigerant passing through the condenser by opening a first supercooling expansion device to allow the refrigerant to be heat-exchanged in a first supercooling heat exchanger and to flow through a first injection tube; and dividing the refrigerant passing through the first supercooling heat exchanger by opening a second supercooling expansion device to allow the refrigerant to be heat-exchanged in a second supercooling heat exchanger and to flow through a third injection tube, wherein, when a first operation mode of the operation mode is performed, each of the first and second compressors performs a three-stage compression with respect to the refrigerant, and when a second operation mode is performed, the refrigerant successively passes through the first and second compressors and is compressed in five stages.

16. The method according to claim 15, wherein the action mode of the valve device comprises:

a first action mode in which the refrigerant compressed in the first compressor is discharged to an inlet-side of the condenser when the first operation mode is performed; and a second action mode in which the refrigerant compressed in the first compressor is discharged to a suction-side of the second compressor when the second operation mode is performed.

17. The method according to claim 15, wherein, when the refrigerant flows through the first injection tube, the refrigerant is decompressed in a first injection expansion device and injected into a high pressure-side of the first compressor.

18. The method according to claim 15, wherein, when the refrigerant flows through the third injection tube, the refrigerant is decompressed in a second injection expansion device and injected into a low pressure-side of the first compressor.

19. The method according to claim 15, wherein the first operation mode is an operation mode in which an operation load higher than a preset load is applied, and the second operation mode is an operation mode in which an operation load less than a preset load is applied.

20. An air conditioner comprising:

first and second compressors for compressing a refrigerant that is injected into the first and second compressors, wherein the compressing comprises multi-stage compression;

a condenser for condensing the refrigerant compressed in the first and second compressors;

a refrigerant separation device for separating the refrigerant before the refrigerant is injected into the first and second compressors;

injection tubes extending from the refrigerant separation device to the first and second compressors to guide the injection of the refrigerant;

a main expansion device disposed at an outlet-side of the refrigerant separation device for decompressing the refrigerant condensed in the condenser;

an evaporator for evaporating the refrigerant decompressed in the main expansion device;

a valve device disposed at an outlet-side of the first compressor for guiding the refrigerant compressed in the first compressor to the condenser or to the second compressor; and a bypass tube extending from the valve device to a suction-side of the second compressor, wherein the valve device operates in a first operation mode such that the refrigerant compressed in the first compressor is mixed with the refrigerant compressed in the second compressor, and wherein the valve device operates in a second operation mode such that the refrigerant compressed in the first compressor is suctioned into the second compressor via the bypass tube.

21. An air conditioner comprising:

first and second compressors for compressing a refrigerant that is injected into the first and second compressors, wherein the compressing comprises multi-stage compression;

a condenser for condensing the refrigerant compressed in the first and second compressors;

a refrigerant separation device for separating the refrigerant before the refrigerant is injected into the first and second compressors;

injection tubes extending from the refrigerant separation device to the first and second compressors to guide the injection of the refrigerant;

a main expansion device disposed at an outlet-side of the refrigerant separation device for decompressing the refrigerant condensed in the condenser;

an evaporator for evaporating the refrigerant decompressed in the main expansion device;

a valve device disposed at an outlet-side of the first compressor for guiding the refrigerant compressed in the first compressor to the condenser or to the second compressor;

a bypass tube extending from the valve device to a suction-side of the second compressor; and a check valve disposed at a suction-side of the second compressor to restrict the refrigerant from the suction-side of the second compressor from flowing to a compressor branch part.

* * * * *